United States Patent [19]

Lau

[11] Patent Number: 4,674,158

[45] Date of Patent: Jun. 23, 1987

[54] ADJUSTABLE BUCKLE

[76] Inventor: Wah Lau, 26 Hung To Road, Kwung Tong, Kowloon, Hong Kong

[21] Appl. No.: 899,055

[22] Filed: Aug. 22, 1986

[51] Int. Cl.[4] ..... A41F 1/00; A44B 11/10

[52] U.S. Cl. ..... 24/580; 24/163 K

[58] Field of Search ..... 24/163 K, 171, 580, 24/573; 2/235, 236

[56] References Cited

U.S. PATENT DOCUMENTS

| | | | |
|---|---|---|---|
| 63,782 | 4/1867 | Caldwell . | |
| 82,142 | 9/1868 | McDonald . | |
| 181,188 | 8/1867 | Lascall . | |
| 390,848 | 10/1888 | Farrell . | |
| 824,745 | 7/1906 | Salisbury . | |
| 849,677 | 4/1907 | Grote . | |
| 878,996 | 2/1907 | Pasley . | |
| 1,134,016 | 3/1930 | Sanders . | |
| 1,702,674 | 2/1929 | Veneman | 24/580 |
| 1,820,918 | 9/1931 | Mackenzie | 24/580 |
| 2,290,573 | 7/1942 | Rasp | 24/171 |
| 2,455,236 | 11/1948 | Darvie et al. | 24/580 |
| 2,475,226 | 2/1945 | Ellis . | |
| 3,063,118 | 11/1962 | Salter . | |
| 3,114,186 | 12/1963 | Olsen . | |
| 3,192,747 | 6/1962 | Stupell et la. . | |
| 3,818,548 | 6/1974 | Meyerson | 24/171 |
| 4,429,439 | 2/1984 | Waugh | 24/573 |
| 4,534,087 | 8/1985 | Lau | 24/163 K |
| 4,566,158 | 1/1986 | Lau | 24/580 |

*Primary Examiner*—Victor N. Sakran

*Attorney, Agent, or Firm*—Lackenbach Siegel Marzullo & Aronson

[57] ABSTRACT

An adjustable buckle system that includes an outer plate member secured to the inner surface of the outer flap of a pair of pants and an inner plate member secured to the outer surface of the inner flap. The outer plate has a pair of opposed gripping channels adapted to slidingly receive the inner plate. A plate spring secured to the inner plate is also positioned in the channels and biases the inner plate against the outer plate. The outer plate has a plurality of spaced stop elements that can be slidingly engaged with a single stop element on the inner plate so that the two plates are locked into a lateral engaged mode at a selected lateral position. The inner plate can be pulled from the outer plate so as to disengage the engaged stop elements so as to allow lateral movement of the two plates to either a new lateral engaged position or to disengagement of the two plates.

10 Claims, 7 Drawing Figures

ADJUSTABLE BUCKLE

FIELD OF THE INVENTION

This invention relates to adjustable buckles and specifically to an adjustable buckle for closing a garment or like object in a plurality of positions.

BACKGROUND OF THE INVENTION

Generally the flaps of pants are closed by buttons, snaps, or the like. A belt is usually used to more selectively position the waist line of the pants to the actual girth of the wearer.

An adjustable buckle which closes a garment to a plurality of fitting positions so as to eliminate the need for a belt is described in U.S. Pat. Nos. 4,534,087 and 4,566,158 to Wah Lau.

Other prior art buckles are described in the following patents:

| U.S. Pat. No. | Inventor | Issue Date |
|---|---|---|
| 63,782 | Caldwell | 4/1867 |
| 82,142 | McDonald | 9/1868 |
| 181,188 | Lascall | 8/1867 |
| 390,848 | Farrell | 10/1888 |
| 824,745 | Salisbury | 7/1906 |
| 849,677 | Grote | 4/1907 |
| 878,996 | Pasley | 2/1907 |
| 1,134,016 | Sanders | 3/1930 |
| 1,820,918 | MacKenzie | 3/1930 |
| 2,290,573 | Rasp | 1/1942 |
| 2,455,236 | Darvie | 11/1948 |
| 2,475,226 | Ellis | 2/1945 |
| 3,063,118 | Salter | 11/1962 |
| 3,114,186 | Olsen | 12/1963 |
| 3,192,747 | Stupell et al. | 6/1962 |
| 4,429,439 | Waugh | 8/1984 |

SUMMARY OF THE INVENTION

It is an object of the present invention to provide a novel adjustable buckle.

It is another object of the present invention to provide a buckle attached to the flaps of a garment adapted to secure the flaps together in a plurality of selected positions.

In accordance with these and other objects which will become apparent hereinafter, there is provided an adjustable buckle system that includes an outer plate member secured to the inner surface of the outer flap of a pair of pants and an inner plate member secured to the outer surface of the inner flap. The outer plate has a pair of opposed gripping channels adapted to slidingly receive the inner plate. A plate spring secured to the inner plate is also positioned in the channels and biases the inner plate against the outer plate. The outer plate has a plurality of spaced stop elements that can be slidingly engaged with a single stop element on the inner plate so that the two plates are locked into a lateral engaged mode at a selected lateral position. The inner plate can be pulled from the outer plate so as to disengage the engaged stop elements so as to allow lateral movement of the two plates to either a new lateral engaged position or to disengagement of the two plates.

DESCRIPTION OF THE PREFERRED EMBODIMENT

Reference is now made in detail to the drawings in numerals refer to the same or similar elements throughout the various views.

Figures 1, 7:
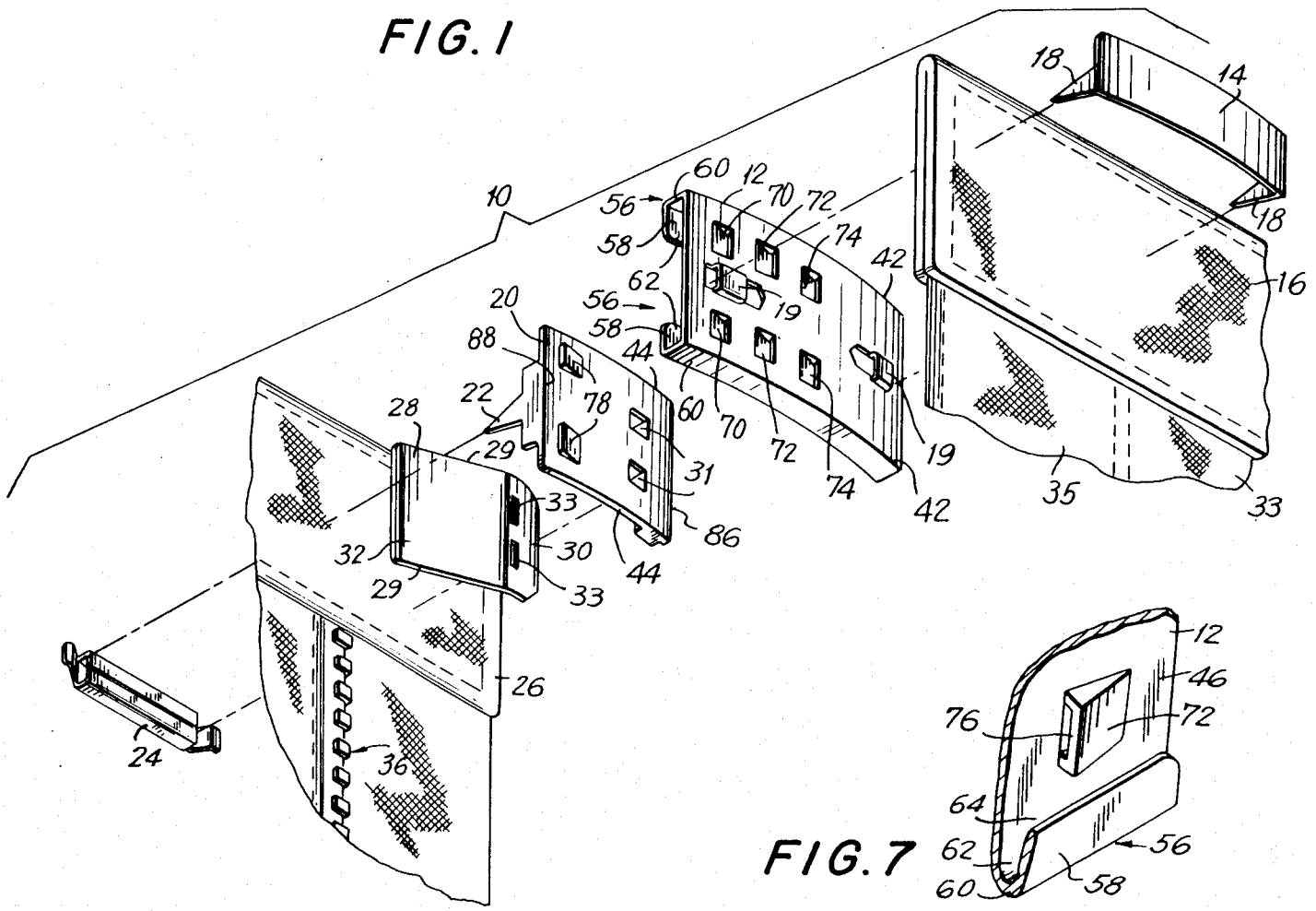
FIG. 1 is an exploded perspective view of the adjustable buckle system.
FIG. 6 is an isolated perspective view of a stop member and a portion of one channel of the outer plate member and FIG. 7 is a fragmentary view of the stop member.
Figure 2:
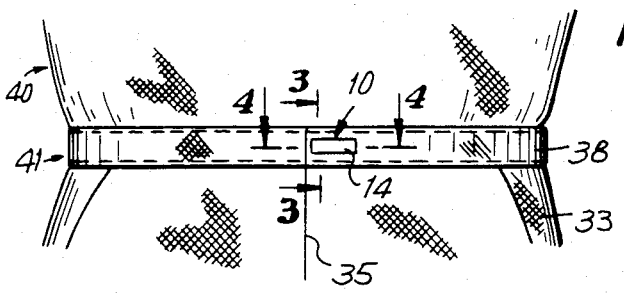
FIG 2. is a front view of the adjustable buckle system in position on the waist of a wearer.
Figure 3:
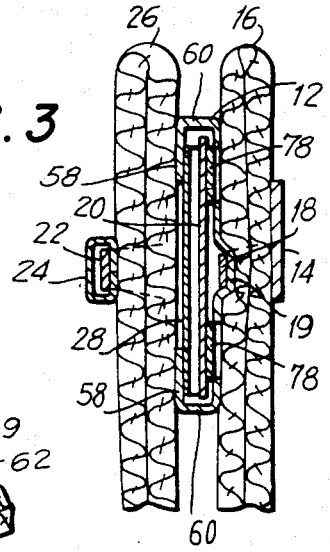
FIG. 3 is a sectional view taken through line 3—3 of FIG. 2 with the line taken only through the first stop element of the outer plate member.
Figure 4:
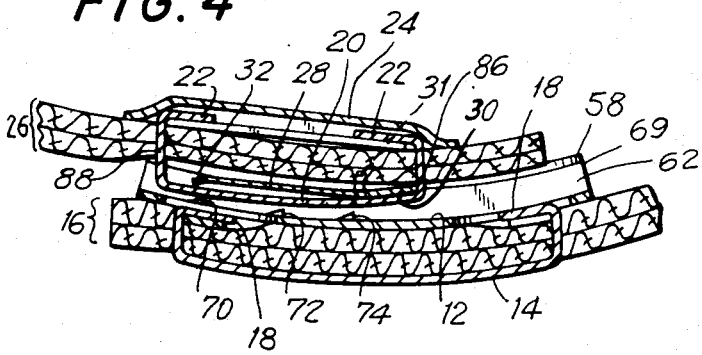
FIG. 4 is a sectional view taken through line 4—4 of FIG. 2 showing the first pair of stop elements of the outer plate member engaged with the pair of stop elements of the inner plate member.
Figure 5:
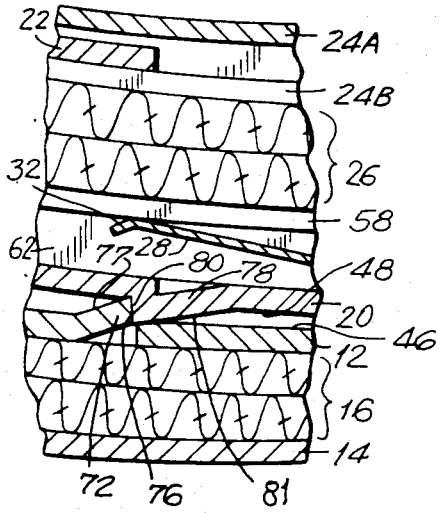
FIG. 5 is an isolated sectional view of the outer and plates in engagement with the second pair of stop elements of the outer plate member engaged with the pair of stop elements of the inner plate member.

An adjustable buckle system 10 is shown in FIG. 1 in an exploded, unassembled view and is shown assembled being worn in FIG. 2 and in sectional views in FIGS. 3 and 4. An outer plate member 12 is gripped by an outer attachment element 14 disposed on the outer surface of an outer material flap 16 and which grips outer plate 12 by a pair of outer element end prongs 18 which extend through flap 16 to grip outer plate 12 through a pair of holes at the ends of the outer plate where the prongs bend towards one another at a pair of grips 19 so as to press outer plate 12 to the inner surface of outer flap 16. An inner plate member 20 includes a pair of end prongs 22 which are gripped in the recesses of an inner attachment element 24 located on the inner surface of an inner material flap 26 so as to hold inner plate 20 to the outer surface of inner flap 26. End prongs fit into the recess formed by the inner and outer walls 24A and 24B, respectively, of element 24 (FIG. 5). A plate spring 28 positioned between outer an inner plates 12 and 20 has an attaching end 30 connected to inner plate 20 and an opposed free end 32. Spring 28 is connected to inner plate 20 by a pair of bent gripping elements 31 that extend from inner plate 20 through a pair of gripping holes 37 at attaching end 30.

Adjustable buckle system 10 is shown in its mounted position in FIG. 2 secured to a pair of pants 34 at the edge of the zipper flap 35 of zipper 36 (FIG. 1) on pants waist band 38 which encircles the waist, or girth, of a person 40 along the imaginary plane 41 of the waist. Outer and inner attachment elements 14 and 20, which, together with outer and inner attachment elements 14 and 24, are preferably arcuate in conformance with the arcuate configuration of the waist plane 41.

Outer plate 12 has a pair of opposed, generally parallel upper and lower edges 42; and inner plate 20 has a pair of opposed, generally parallel upper and lower edges 44. Edges 42 and 44 are disposed generally parallel to waist plane 41, and the upper edges 42 are generally aligned with upper edges 44 and the lower edges 42 are generally aligned with lower edges 44. Outer plate 12 has an inner surface 46 and inner plate 20 has an outer surface 48; inner and outer surfaces 46 and 48 are in proximate relationship when the two plates are engaged as will be discussed below.

A pair of opposed L-shaped gripping, or channel, elements 56 are connected to upper and lower edges 42 of outer plate 12 and extend inwardly from inner surface 46. Channel elements 56 each include side walls 58 that extend lateral to and opposite inner surface 46 and connecting walls 60 that join upper and lower edges 42 with side walls 58. Channel elements 56 and outer plate 12 define a pair of channels 62 having opposed openings 64 having open ends; channels 62 are capable of slidably receiving upper and lower edges 44 of inner plate 20 so that outer and inner plates 12 and 20 are in lateral sliding relationship in a transverse engaged mode, that is, when outer and inner plates 12 and 20 are held in substantial transverse locked relationship with spring 28 in a basic biasing mode pressing inner plate 20 toward outer plate 12.

Inner plate 20 has a lead edge 66 and an opposed trailing edge 68 which are transverse to upper and lower edges 44. Attaching end 30 of plate spring 28 is connected to outer surface 48 of inner plate 20 at leading edge 66, which is adapted to enter channels 62 at their entry ends 69 when inner plate 20 is being mounted to outer plate 12 in the transverse engaged mode from the release, or separated, position wherein the two plates are totally disconnected from one another. Free end 32 of spring 28 is positioned proximate trailing edge 68 of inner plate 20. Spring edges 29 are adapted to enter channels 62 at attaching end 30 along with edges 44 of inner plate 20 when inner plate 20 is slidably mounted into channels 62. Spring 28 is shown in its unbiased mode in FIG. 1. When spring 28 enters channels 62, free end 32 is pressed by side walls 58 into a first biased mode as shown in FIG. 4 and more clearly in FIG. 5.

Outer plate 12 includes three pairs of stop elements 70, 72, and 74, which extend from inner surface 46 towards inner plate 20 and which are spaced from one another at appropriate distances in accordance with desired spacings for adjusting the circumference of waist band 38. Each stop element of the pairs of stop elements mentioned is positioned proximate to one of the upper and lower edges 42. although three pairs of stop elements are shown, the number of stop elements extending from outer plate 12 can vary. Each stop element of the pairs of stop elements 70, 72, and 74 includes a stop face typified by stop face 76 of the second stop element 72 seen in isolation in FIGS. 5 and 6. Stop face 76 is transverse to waist plane 41 and is oriented toward entry end 69 of channels 62, which are also the releasing ends of channels 62 when inner plate 20 is being slid into a release position wherein the inner and outer plates are separated from one another. Each of the mentioned stop elements also includes a sloped wall, or ramp, 77 which extends from the top side of each element to inner surface 46 and which is oriented in a direction opposite to stop face 76. The first stop element 70 is positioned at the end of outer plate 12 that is distal from entry end 69, while the second and third stop elements 72 and 74, respectively, are positioned successively towards entry end 69, with stop element 74 still spaced at some distance from entry end 69.

Figure 6:
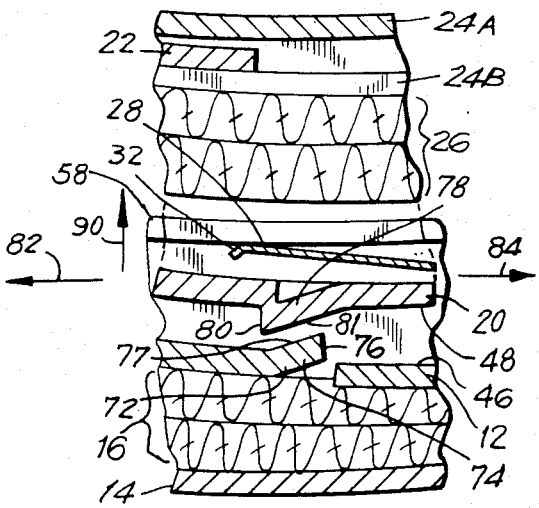

Inner plate 20 includes a single pair of stop elements 78, which extend from outer surface 48 towards outer plate 12 and are positioned proximate to trailing end 88. Each of the pair of stop elements 78 are positioned proximate one of the upper and lower edges 44. Each of the pair of stop elements includes a stop face 80, which is shown in FIGS. 5 and 6. Stop face 80 is transverse to waist plane 41 and is oriented toward trailing end 88 of inner plate 20. Each of the pair of stop elements 78 preferably includes a ramp 81 which extends from the top side of each stop element to outer surface 48 and which is oriented in a direction opposite to stop face 80.

Each of the pairs of stop elements 70, 72, and 74 is adapted to be removably locked together in a lateral engaged mode with the pair of stop elements 78 as selected by the wearer when outer and inner plates 12 and 20 are held in lateral locked relationship. First of all, outer and inner plates 12 and 20 are already in a transverse engaged mode with spring 28 biasing inner plate 20 toward outer plate 12. In the lateral engaged mode the stop faces 76 of the selected pair of stop elements 70, 72, and 74 is in pressure contact with stop faces 80 of the pair of stop elements 78. When inner plate 20, for example, is pressed in the disengaged direction, indicated by directional arrow 82 (FIG. 5), to disengage inner plate 20 from outer plate 12, stop faces 76 and 80 come into pressure contact and lateral movement in the release direction is prevented. Initial and continued lateral movement in the engaged direction, indicated by directional arrow 84 (FIG. 5), is facilitated by stop elements 70, 72, or 74 and stop elements 80 being adapted to move past one another via ramps 77 and 81 until a lateral position is reached where the two plates are in a lateral engaged mode.

Outer and inner plates 12 and 20 are released from the lateral engaged mode by a slight transverse movement of inner plate 20 in channels 62 by pressure exerted by the wearer so that inner plate 20 is moved toward side walls 58 of channels 62 and free end 32 of plate spring 28 is pressured between side walls 58 and inner plate 20 to a second biased mode greater in bias than the ordinary biased mode. This movement is indicated by directional arrow 90 in FIG. 5. At this time stop elements 78 of inner plate 20 are released from their engagement with the selected stop elements 70, 72, or 74 and inner plate 20 and outer plate 12 are released from the transverse engaged mode to only the lateral engaged mode. At this time inner plate 20 can be moved laterally relative to outer plate 12 either in disengaging direction 82 to a new lateral engaged position or to complete disengagement of the two plates or in engaging direction 84 to a new lateral engaged position. It is noted that it is possible to move inner plate 20 through channels 62 in the engaging direction 84 until inner plate 20 is completely disengaged from outer plate 12. This movement, however, is not always a practical alternative since waist band 38 would be pulled into a decreased circumference that might be uncomfortable for the wearer. It is this pressure that naturally inhibits inner plate 20 from sliding in the engaging direction. It is to be noted, however, that the biasing action of spring 28 also prevents ramps 77 and 78 of the stop elements from being pressed past one another in the engaging direction and that pressure from the wear is needed to overcome the bias of the spring.

It is noted that the positions of outer plate 12 with its feature and of inner plate 20 with its features could be reversed within the scope of the invention.

It is of course to be understood that various modifications may be made that are within the contemplation of the invention as defined in the appended claims.

What is claimed is:

1. An adjustable buckle, comprising, in combination, a first member having first engaging means, means for attaching said first member to the rear face of a first material flap, a second member having second engaging means, means for attaching said second member to the front face of a second material flap, said first and second engaging means are capable of being removably engaged in a lateral engaged mode wherein said first and second members are held in lateral locked relationship in at least one lateral position relative to one another, gripping means connected to said first member for removably holding said second member in a transverse engaged mode wherein said first and second members are held in substantial transverse locked relationship relative to one another, and biasing means connected to said second member and associated with said gripping means for removably holding said first and second engaging means in said lateral engaged mode in a first biased mode, said first and second members being slightly transversely movable relative to one another in said lateral engaged mode between said at least one lateral position and a first release position wherein said biasing means is placed in a second biased mode greater than said first biased mode and said first and second members are removed from said lateral engaged mode to be placed only in said transverse engaged mode to a second release position wherein said first and second members can be separated from one another, and wherein said at least one lateral position is a plurality of lateral positions, with said first and second members being further laterally movable relative to one another in said lateral engaged mode between said plurality of said lateral positions.

2. The adjustable buckle as described in claim 1, wherein said first member is a first plate member having opposed generally parallel first edges disposed generally parallel to the plane of the waist of a body and connected to said gripping means, and said second member is a second plate member having opposed generally parallel second edges disposed in general parallel alignment with said first edges, said gripping means being for receiving said second edges in sliding relationship in the transverse engaged mode.

3. The adjustable buckle as described in claim 2, wherein said gripping means includes said first plate member having a first surface proximate said second plate member and a pair of opposed channel elements connected to said first edges, said channel elements including side walls lateral to and opposite said first surface and connecting walls joining said first edges and said side walls, said channel elements and said first plate member defining a pair of channels having opposed openings disposed adjacent to said first surface, said channels being capable of receiving said second edges of said second plate member in lateral sliding relationship in said transverse engaged mode.

4. The adjustable buckle as described in claim 3, wherein said second plate member has a second surface proximate said first surface in said transverse engaged mode, and said biasing means is a plate spring having opposed connecting and free ends, said connecting end being attached to said second surface, said biasing spring being positioned is said pair of channels in said first and second biased mode at said free end by said side walls of said channel elements.

5. The adjustable buckle as described in claim 4, wherein said first engaging means is at least one first stop element extending from said first surface and including a first stop face transverse to the waist plane and oriented toward said second release position; and said second engaging means is at least one second stop element extending from said second surface and including a second stop face transverse to the waist plane and oriented away from said second release position; said at least one first stop element and said at least one second stop element being adapted to be removably locked together in said lateral engaged mode, said first stop face and said second stop face being in pressure contact when said first and second plate members are in said lateral engaged mode, said at least one first stop element being transversely unlocked from said at least one second stop element and moved to said first release position when said second plate member is moved transverse to said first plate member, said free end of said plate spring being moved to the second biased position by said side walls of said channel member.

6. The adjustable buckle as described in claim 5, wherein said at least one first stop element includes a top side and a first ramp extending from said top side to said first surface, said first ramp being oriented in a direction opposite to said first stop face; and said at least one second stop element includes a top side and a second ramp extending from said top side to said second surface, said second ramp being oriented in a direction opposite to said second stop face; wherein said at least one first stop element and said at least one second stop element are adapted to move past one another via said first and second ramps when said first and second plate members are moved from said second release position to said at least one lateral position.

7. The adjustable buckle as described in claim 6, wherein said at least one first stop member is a pair of transversely aligned first stop elements each positioned proximate to one of said first edges of said first plate member; and said at least one second stop element is a pair of second stop elements each positioned proximate to one of said second edges of said second plate member.

8. The adjustable buckle as described in claim 7, wherein said pair of first stop elements is a plurality of spaced pairs of first stop elements, each pair of said plurality of first stop elements being adapted to lock with said pair of second stop elements in said transverse engaged mode.

9. The adjustable buckle as described in claim 8, wherein said first and second plate members are arcuate in configuration in conformity to the waist of the body of the wearer.

10. The adjustable buckle as described in claim 9, wherein the first material flap is the outer flap and the second material flap is the inner flap, and said first plate member is attached to the rear face of the outer flap and said second plate member is attached to the front face of the inner flap.

* * * * *